United States Patent [19]

Elkins

[11] Patent Number: 4,630,680

[45] Date of Patent: Dec. 23, 1986

[54] WELL CONTROL METHOD AND APPARATUS

[75] Inventor: Hubert L. Elkins, Kingwood, Tex.

[73] Assignee: Hydril Company, Los Angeles, Calif.

[21] Appl. No.: 712,907

[22] Filed: Mar. 15, 1985

Related U.S. Application Data

[63] Continuation of Ser. No. 461,618, Jan. 27, 1983, abandoned.

[51] Int. Cl.[4] ..... E21B 43/01

[52] U.S. Cl. ..... 166/34.2; 166/364; 166/368; 166/341

[58] Field of Search ..... 166/363, 364, 351, 344, 166/342, 341, 84, 82

[56] References Cited

U.S. PATENT DOCUMENTS

| | | | |
|---|---|---|---|
| 3,548,934 | 12/1970 | Hutchison | 166/365 X |
| 3,554,277 | 1/1971 | Bauer | 166/342 |
| 4,046,191 | 9/1977 | Neath | 166/364 |
| 4,387,771 | 6/1983 | Jones | 166/341 |
| 4,405,016 | 9/1983 | Best | 166/341 X |

*Primary Examiner*—Stephen J. Novosad
*Assistant Examiner*—Thuy M. Bui
*Attorney, Agent, or Firm*—Dodge, Bush & Moseley

[57] ABSTRACT

A method and apparatus is disclosed for controlling a well drilled from a floating drilling vessel during the time that the marine riser is removed and conductor casing is being lowered and cemented into the well. An annular blowout preventer having a bore substantially equal to that of the structural casing is provided in a stack above the structural casing wellhead housing. A kill line is provided to the drilling vessel and is connected to the wellbore conduit below the blowout preventer. A marine riser is attached to the top of the blowout preventer through which the hole to be lined with conductor casing is drilled. The well is established to a depth of about one thousand (1000) feet below the seabed.

The annular blowout preventer is closed, the marine riser is removed, and a stripper and guidance assembly is landed on the top of the blowout preventer in preparation for lowering the conductor casing in the well. The conductor casing, with a second wellhead housing attached to the top thereof, is stripped into the well, the second wellhead housing landing within the structural casing wellhead housing. The conductor casing is then cemented in the hole.

Well pressure is monitored by means of a surface disposed pressure gauge attached to the top of the kill line. Excess well pressure is relieved by means of the kill line or by means of a vent valve provided in the structural casing wellhead housing.

30 Claims, 8 Drawing Figures

FIG. 3
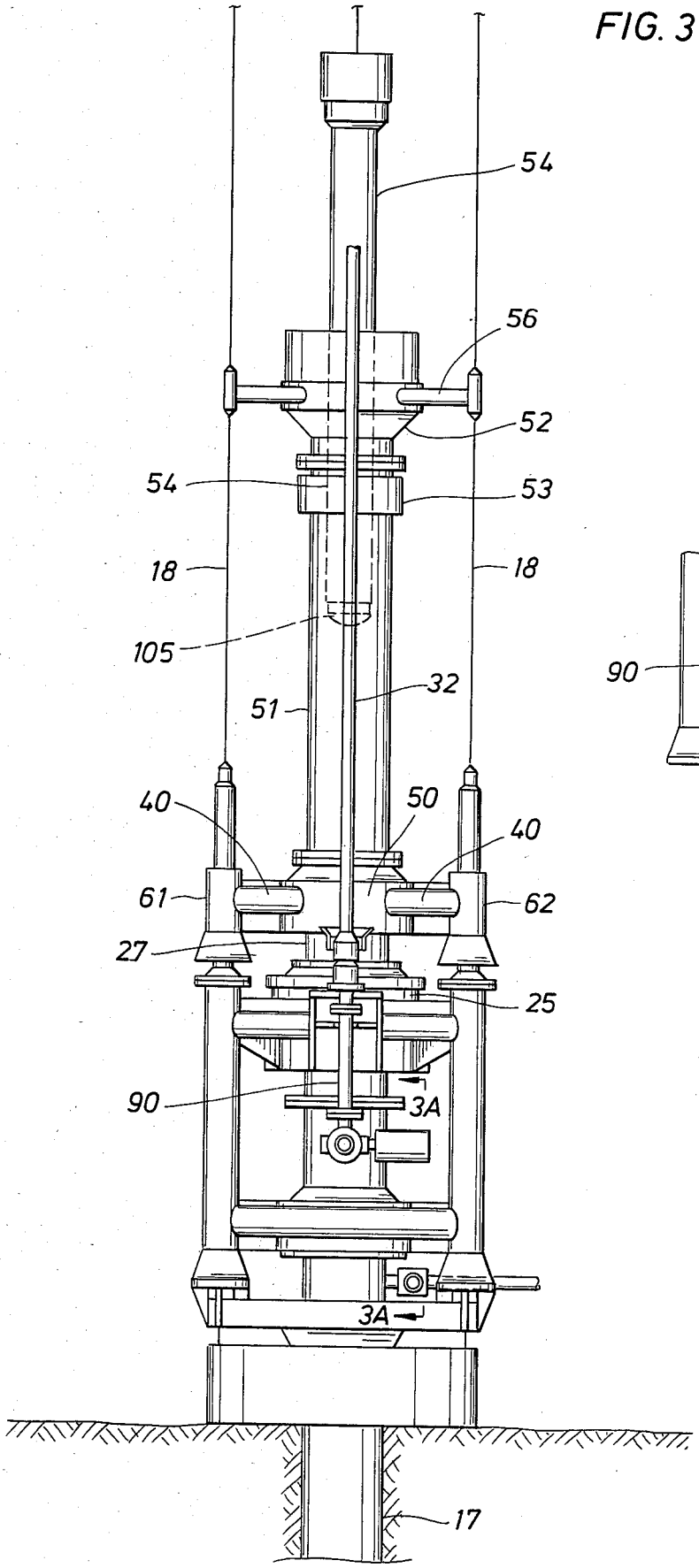
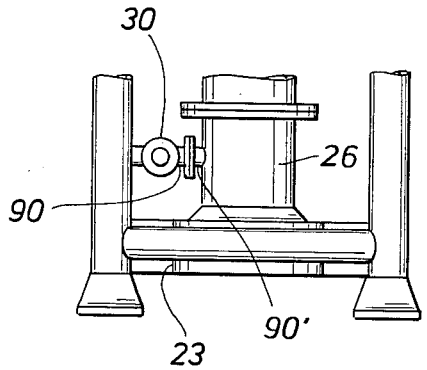
FIG. 3A

WELL CONTROL METHOD AND APPARATUS

This application is a continuation of application Ser. No. 06/461,618, filed Jan. 27, 1983 now abandoned.

BACKGROUND OF THE INVENTION

1. Field of the Invention

The invention relates in general to a well control method and apparatus and in particular relates to the control of a well drilled from a floating drilling vessel while establishing conductor casing in the well. The floating drilling vessels include not only drilling barges, but also ship-like vessels that look like a normal vessel with a drilling rig on it, and semi-submersible vessels, also called column stabilized units, or "semis". Still more particularly, the invention relates to controlling kicks in a well after the marine riser has been removed and during operations where conductor casing is lowered into the hole and cemented to the structural casing and the open hole therebelow.

2. Description of the Prior Art

In drilling operations from a floating vessel, the well is started or spudded by using a heavy steel template to guide the bit to the right spot on the ocean floor. The template has four attached guidelines to guide the equipment to the well before the riser has been run. The template is run to the seabed on drill pipe and released mechanically.

A thirty-six (36) inch bit is run and guided by arms riding on the guidelines so that the bit enters the hole in the template. The guide arms may be of the breakaway variety that are released by the parting of shear pins or the like after the bit has entered the hole in the template. The arms are retrieved to the surface by means of attached tugger lines.

The thirty-six (36) inch hole is drilled from eighty to three hundred feet below the mud line. The drilling tools are then removed and thirty (30) inch casing called "structural casing" is run into the hole and cemented in the hole.

The depth of the thirty-six (36) inch hole is determined taking into account the ability of the sea floor surface to support the wellhead and equipment with the vertical loading or overturning moment used as the criteria for design. If a riser is to be used while drilling the hole for the second casing, called "conductor casing", the ability of the formation to withstand the hydrostatic pressure of the drilling fluid, called "mud", in the riser must be considered also. Typically the structural casing string extends to one hundred (100) feet beneath the seabed while the conductor casing string typically extends to one thousand (1000) feet and more below the sea floor.

Attached to the top of the thirty (30) inch structural casing is a thirty (30) inch wellhead housing with a permanent guide base attached thereto. This housing and guide base is lowered onto the ocean floor until the permanent guide base rests upon the drilling template.

The guide base has guide posts for supporting a blowout preventer stack. The posts are usually hollow and the guidelines are inserted into the hollow guide posts before the permanent guide base is lowered onto the ocean floor for resting on the template.

The prior art methods for drilling subsea wells from floating vessels have typically included as the next step the connection of a marine drilling riser to the thirty (30) inch wellhead housing. A hydraulic connector secures the riser to the wellhead housing. Typically the prior art methods have drilled through the marine riser and through the structural casing into the subsea formations with a pilot hole to the depth to which the conductor casing is desired to be placed. The conductor casing is used to seal off very low integrity formations. It has typically been set to about one thousand (1000) feet or more below the mud line.

In many areas of the world, shallow gas formations have caused blowouts, and consequently, the drilling industry typically uses a diverter system attached to the top of the riser while drilling the hole for the conductor casing. Flow diverters are low pressure annular preventers used to direct the flow of drilling fluids away from the rig floor. In addition to the usual hazards of fire and explosion, a gas blowout at sea can sink a vessel. Gas in the water lowers the density of the fluids supporting the vessel, sometimes to the point where the vessel loses its reserve buoyancy and may even sink. Thus prior art drilling operations have developed the approach of bringing pressurized gas or fluid in the drilling mud to the surface via the riser and venting via a vent line—diverter system while re-establishing control of the well, rather than venting the well subsea.

In deep water drilling, a dump valve or a lift line has been used to decrease the hydrostatic pressure at the wellhead. Dump valves, capable of being opened to dump the cuttings to the seabed, have been located near the bottom of the riser. A lift line from the vessel to the bottom of the riser has been provided through which water, mud or inert gas has been injected to decrease the hydrostatic pressure.

With the riser in place, a pilot hole is drilled through the riser. The pilot hole is then opened to twenty-six (26) inches by means of a collapsible reamer. Before the riser is pulled, the mud is conditioned and a weighted mud is applied to the well to account for the loss in hydrostatic pressure caused by pulling the riser. The next step in the drilling process calls for inserting twenty inch conductor casing with an eighteen and three quarter (18¾) inch wellhead housing attached to the top thereto into the hole. Prior art drilling methods have required that the riser be pulled because its inside diameter is too small to accept the twenty (20) inch conductor casing with the eighteen and three quarter (18¾) inch wellhead housing attached.

Having pulled the riser, the eighteen and three quarter (18¾) inch wellhead housing and conductor casing have typically been run and cemented with the return to the sea floor. Although most operators use twenty inch conductor casing with an eighteen and three quarter inch wellhead housing, a few well operators may use a conductor string of eighteen and five eighths (18⅝) or twenty (20) inch casing topped by a sixteen and three quarter (16¾) inch wellhead housing. The wellhead housing, typically one of eighteen and three quarter (18¾) inch size, is landed by means of complementary landing shoulders within the thirty (30) inch wellhead housing attached to the structural casing. After the riser has been pulled and while the conductor casing is being run and cemented into the well, the well has been without effective control.

Thus, the prior art drilling procedures have called for removing the riser and then running the twenty (20) inch conductor casing with no protection against kicks, while lowering it to and within the thirty (30) inch structural casing and finally into position; during this time, the hole is open to the sea. The wellhead housing attached to the top of the conductor casing is later used to connect the primary blowout preventer stack that will be used for the rest of the drilling program. The conductor casing is then cemented into position all the way back to the ocean floor.

During the time that the marine riser is removed and the conductor casing is being prepared to run and is run into the thirty (30) inch structural casing hole, the hole may have experienced a blowout and, in blowing out, may have caved in or cratered. The drilling operator may find when the conductor casing is being lowered for insertion into the thirty (30) inch structural casing hole that there is a heavy flow of gas out of the hole and that it is impossible to stab the conductor casing into it. Thus, there is no control of the well. The only procedure left open to the operator is to wait until the well quits flowing. Such waiting may take hours to days.

If the operator finds that the well is out of control, he may elect to return the conductor casing back to the surface and to run drill pipe down to the hole and try to stab it into the hole. If the operator is successful in this procedure and the hole has caved in, the well may have to be redrilled.

Another procedure available to the operator if the blowout is substantial, may involve pumping quick set cement into the hole and abandoning the well. So there has existed a problem with prior art drilling from floating drilling rigs of there being a time in the drilling procedure in which the hole is without effective control. Even worse, the operator has had no means to know the pressure conditions of the drill hole once the marine riser is removed, and indeed may not fully realize the condition of the hole until he goes back down with equipment seeking to lower the conductor casing into the hole.

An object of this invention is to provide a method and apparatus for controlling a subsea well after the marine riser has been removed and during the time that twenty (20) inch conductor casing is being lowered and cemented into the well.

It is a further object of the invention to provide a means for monitoring the well pressure in the hole after the marine riser has been removed.

It is a further object of the invention to provide casing guidance and stripping apparatus whereby the conductor casing may be lowered into the well while maintaining control over the well at all times.

SUMMARY

According to the invention, well apparatus is provided for use with a floating drilling vessel which is adapted for connection to the structural casing string in a borehole established beneath a drilling template, or temporary guide base on the seabed. The apparatus includes a wellhead housing connected to the structural casing string and a permanent guide base resting on the drilling template and disposed about the housing. The permanent guide base has vertically extending male guide posts for guiding a blowout preventer stack frame. The blowout preventer stack is lowered for connection to the wellhead housing and guided by the stack frame lowered along the guide wires. A first wellhead connector is latched to the wellhead housing, and an annular blowout preventer supported by the stack frame is connected to the wellhead housing by means of a first conduit providing a flow path between the bore of the wellhead housing and the bore of the blowout preventer.

A valve is disposed in a line connected to the first conduit. A kill line is connected to the line at the blowout preventer stack and extends to the surface of the drilling vessel. A pressure gauge is disposed in the kill line at the surface.

A second conduit attached to the top of the blowout preventer is connected to a second wellhead connector which is connected to a marine riser adapter frame. A marine riser and flow diverting system is releasably secured to the second wellhead connector.

After the riser system has been removed, a guiding and stripping assembly is connected to the second wellhead connector providing a means to guide the twenty (20) inch conductor casing through the blowout preventer into the structural casing string while simultaneously providing a stripping means to maintain well control. A surface controlled vent valve disposed in a line to the first conduit is provided for subsea venting of the well in the event of high well pressure during the stripping operations.

An eighteen and three quarter (18¾) inch wellhead housing attached to the top of the conductor casing is provided for landing in the thirty (30) inch structural casing wellhead housing. An elastomeric seal is disposed between the walls of the two wellhead housings below the complementary landing shoulders of the two wellhead housings in order to prevent cement returns during the cementing of the conductor casing from passing to and fouling the annular blowout preventer.

The casing stripper and guiding apparatus according to the invention is attached to the top of a wellhead connector connected to a conduit extending from the top of the blowout preventer, and is adapted for running the conductor casing into the well via the blowout preventer. A spool is connected to the wellhead connector and has an inside diameter substantially the same as that of the blowout preventer and extends upwardly from the blowout preventer. A stripper assembly means is attached to the spool upwardly from the blowout preventer for stripping conductor casing therethrough. A retaining means is provided near the stripper assembly for releasably connecting the conductor casing to the stripper assembly.

According to the invention, the apparatus described above is used in conjunction with a method to control the well while establishing the conductor casing in the well. The method includes the step of drilling the well by means of a bit and drill pipe extending through the riser and blowout preventer to a depth for establishing the conductor casing. Diverting apparatus is established at the top of the riser to divert any kicks encountered while drilling the pilot hole or during the underreaming of the pilot hole. The drill string is removed from the well and the annular blowout preventer is actuated for complete shut off. The wellhead connector is then disconnected from the blowout preventer and the riser and connector are removed from atop the blowout preventer. The stripper and guidance assembly with a conductor casing releasably secured therein is guided to the top of the blowout preventer and attached to the conduit from the top thereof by means of a wellhead connector. The blowout preventer is then opened, and the conductor casing is stripped into the well.

The method of the invention also includes the steps of monitoring the well pressure by means of a pressure gauge disposed at the drilling rig and attached to the kill line extending from the first conduit to the drilling rig after the annular blowout preventer is actuated for complete shut off and, if pressure occurs in the well, venting the well by means of the kill line or the vent valve in a line connected to the first wellhead housing.

The method also includes the steps of securing a cementing shoe to the end of the conductor casing, attaching the conductor casing to a release means connected to the stripping means for releasably securing the conductor casing to the stripper and guidance assembly, landing the stripper and guidance assembly on the second wellhead connector above the annular blowout preventer, actuating the shear release means to allow the conductor means to move up and down with respect to the stripping means to compensate for rig heave, and connecting the lower end of the stripper and guidance assembly to the second wellhead connector.

According to another feature of the invention, the annular blowout preventer may be used to strip the conductor casing into the well if the stripping means has become damaged.

According to another feature of the invention, a second wellhead housing is secured to the top of the length of the conductor casing and is lowered with the conductor casing through the blowout preventer into landing engagement with the first wellhead housing.

According to still another feature of the invention, as the conductor casing is cemented into the well, the vent valve disposed in a line to the first wellhead housing is opened to provide a circulation return for the cement.

The apparatus according to the invention is removed by disconnecting and removing the kill line from the blowout preventer stack and disconnecting and removing the stripper and guidance assembly and the blowout preventer from connection with the first wellhead housing.

BRIEF DESCRIPTION OF THE DRAWINGS

The objects, features and advantages of the invention will be better understood from the following description taken in conjunction with the accompanying drawings in which:

FIG. 3 shows the apparatus with the marine riser removed and a guidance and stripper assembly disposed atop the thirty (30) inch blowout preventer stack for the purpose of lowering the conductor casing into the well while maintaining control over the well;

FIG. 3A illustrates more clearly the circulating line and valve connected below the blowout preventer;

DESCRIPTION OF THE INVENTION

Figure 1:
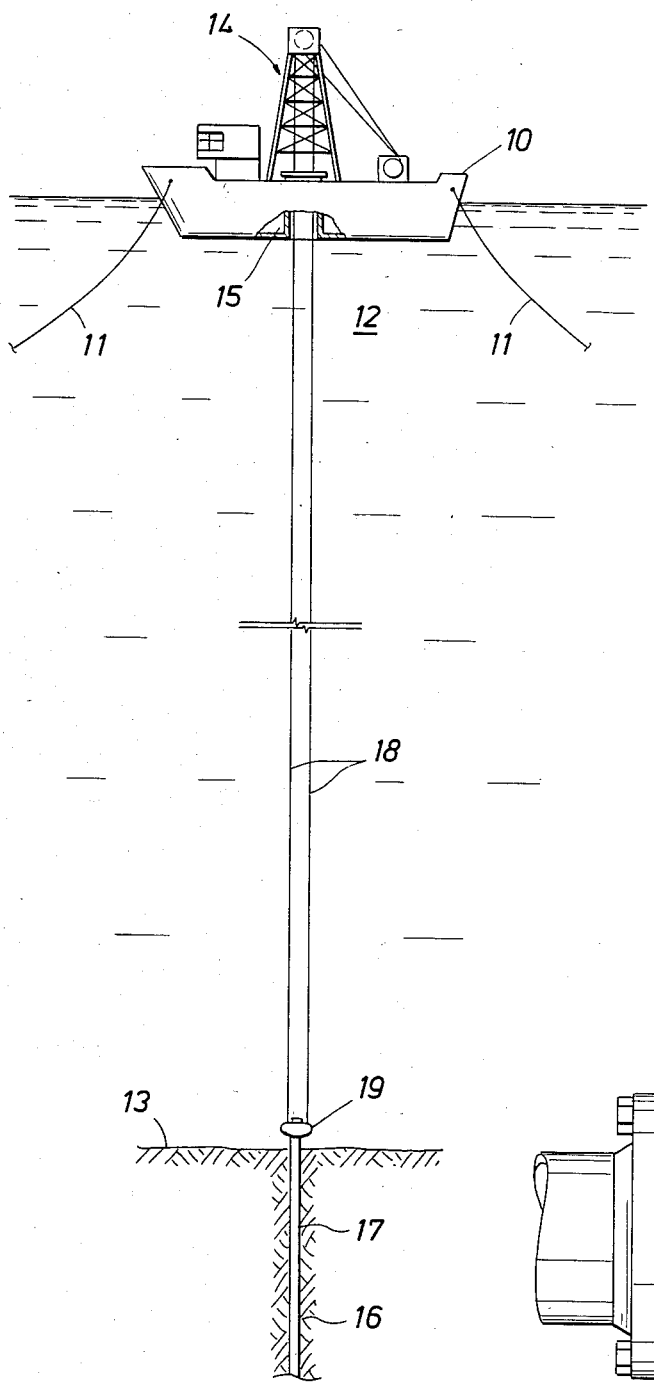
FIG. 1 is an illustration depicting a floating platform or vessel over a subsea well site or formation with guide means interconnecting the vessel and wellhead.

Referring first to FIG. 1, a floating vessel or platform such as the ship 10 is first anchored by the anchor lines 11 in a body of water 12 above the seabed 13. The vessel or ship 10 is provided with a conventional drilling rig indicated generally at 14 positioned over a cellar or slot 15 through the center of the vessel. A previously drilled hole is indicated generally at 16 in the formation 13 with a structural casing 17 cemented into place. Structural casing 17 may be set in the well by any conventional method, as for example by being stripped down over the drilling pipe or by means of the guidelines 18 fastened to the temporary wellhead guide base 19. Although the preferred means for guiding apparatus to the wellhead according to the invention is by guidelines 18, other guidance systems such as acoustic or television based systems may be used which are known in the art of marine drilling.

Figure 2:
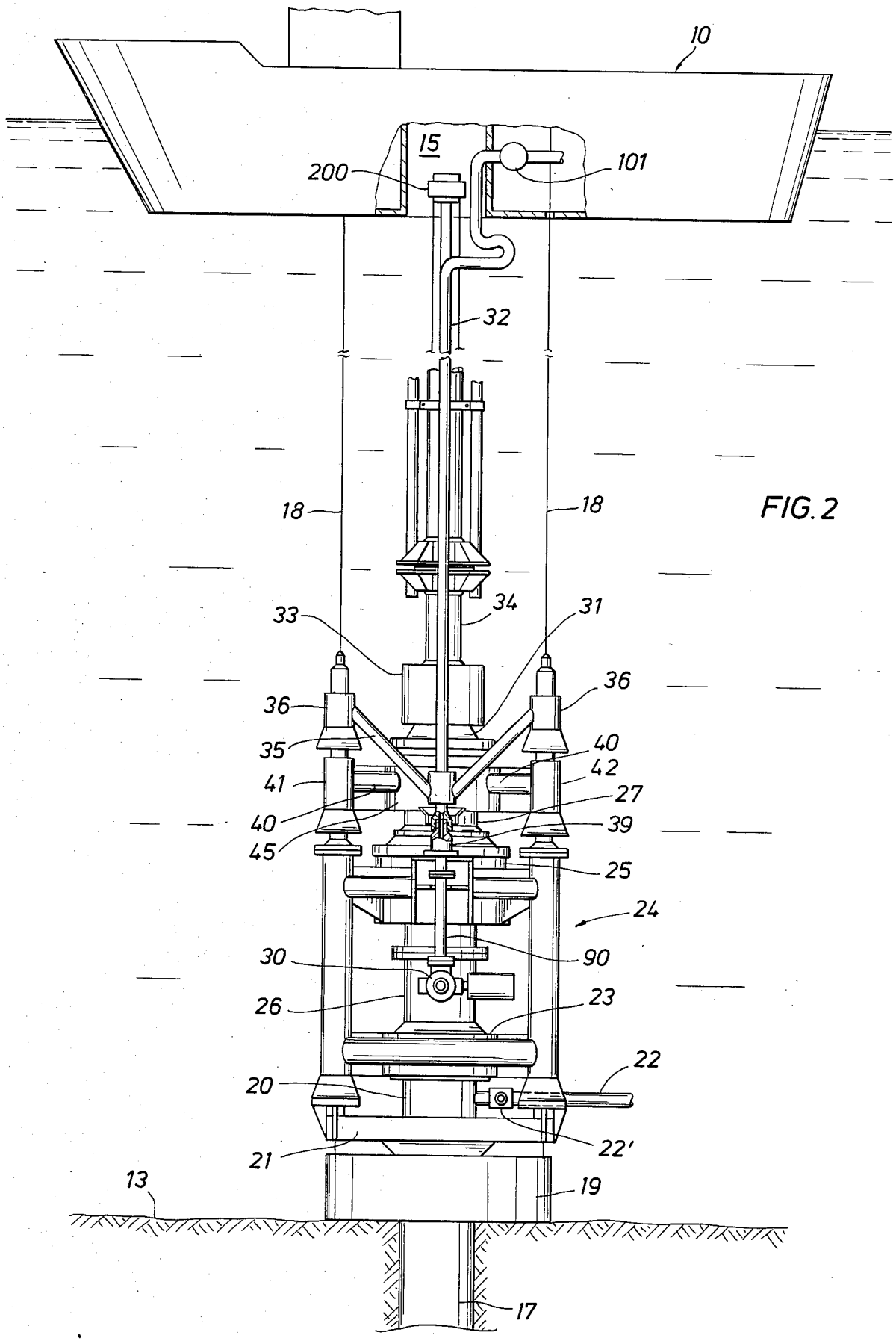
FIG. 2 illustrates apparatus connected to the wellhead including a marine riser system used in drilling a hole to accept the conductor casing of the well.

FIG. 2 illustrates the wellhead apparatus to be placed above the thirty (30) inch structural casing 17 which is cemented in the bore in the sea floor. The purpose of the apparatus is to enable the drilling operator to have complete control over the drilling of the hole through the structural casing 17 and the placing of conductor casing typically to a depth of one thousand (1000) feet or more. The apparatus adapted to accomplish the well control includes an annular blowout preventer disposed in line with the structural casing and a marine riser attached to the top of the blowout preventer.

The well is drilled by means of a drilling string extending through the bore of the riser and annular blowout preventer until the hole for the twenty (20) inch conductor casing has been opened. A flow diverter at the top of the marine riser provides means to divert pressurized gas and fluid which may result from geologic structures opened by the drilling operation. The apparatus is adapted to allow removal of the marine riser while controlling the well by closing the annular blowout preventer and for replacing the riser with a stripper and guidance assembly at the top of the blowout preventer, whereby the conductor casing may be inserted into the well while maintaining control at all times.

Turning now to the particulars of the apparatus as illustrated in FIG. 2, a thirty (30) inch wellhead housing 20 is provided above the permanent guide base 21 resting upon the template, or temporary wellhead guide base 19. A vent line 22, preferably having a ten inch bore, is connected in the wall of the wellhead housing. A valve 22' is disposed in line 22. Construction details of the wellhead housing 20 will be described below when referring to FIG. 4.

A thirty (30) inch wellhead connector 23 is connected to the top of the thirty (30) inch wellhead housing 20 and supports a blowout preventer stack shown generally at 24. The permanent guide base 21 includes four posts extending upwardly from the base 21 and guides into position the wellhead connector 23 and an annular blowout preventer 25. Such a permanent guide base is commercially available, for example from the VETCO company and is illustrated at page 6833 in the Composite Catalog of Oil Field Equipment and Services, 1978–1979 edition, of Gulf Publishing Company.

A drilling spool 26 is provided between the connector 23 and the blowout preventer 25. Alternatively, an extended upper neck or mandrel of the connector 23 may be provided for connection to the bottom of the blowout preventer 25.

Figure 2A:
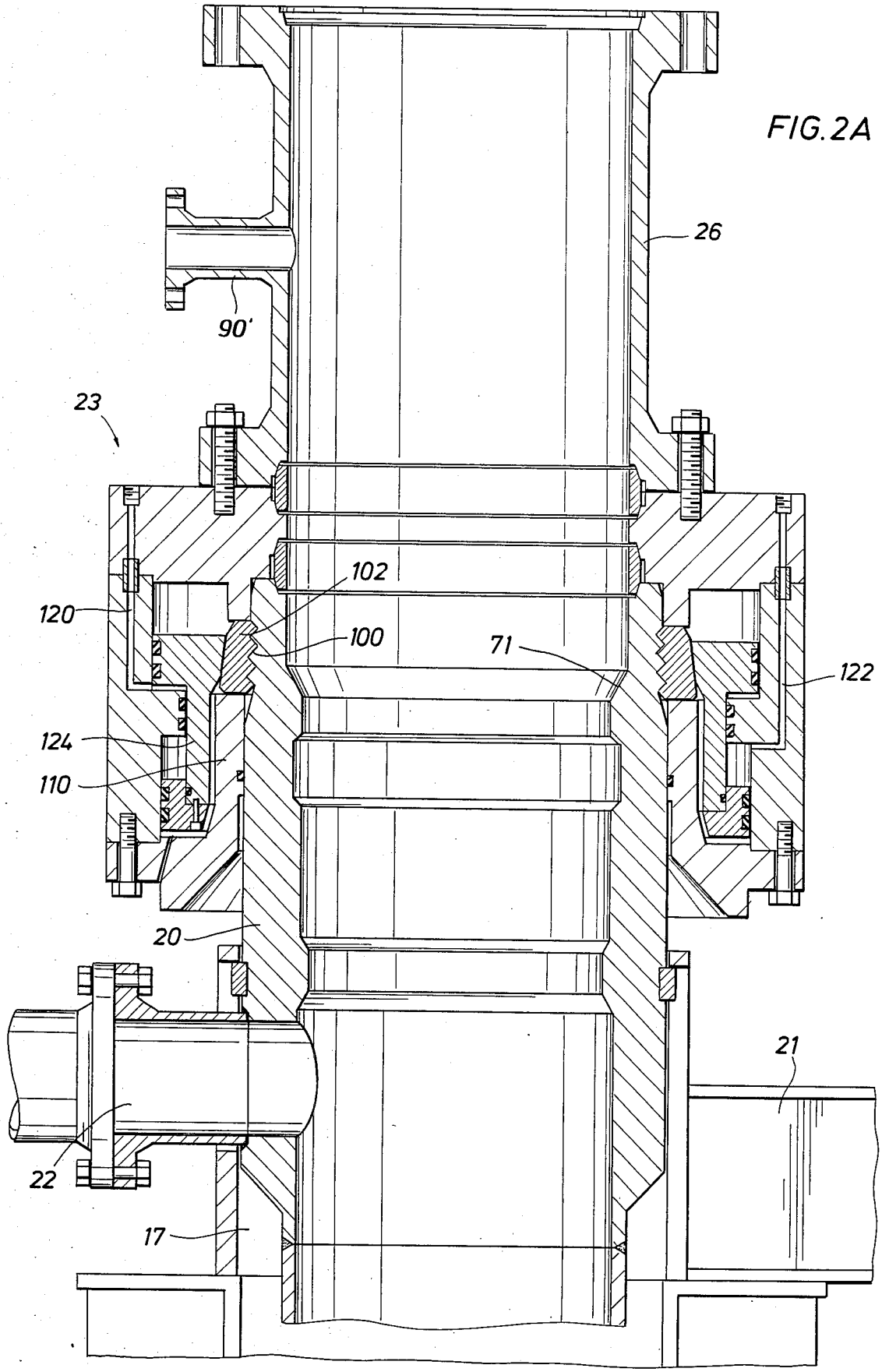
FIG. 2A illustrates the wellhead profile and wellhead connector of the apparatus.

FIG. 2A illustrates the connection of the drilling spool 26 to the thirty (30) inch wellhead housing 20 by means of hydraulic connector 23 which is rigidly attached to drilling spool 26. A locking profile 100 in the wellhead housing 20 is provided for the engagement of complementary profiled locking dogs 102. The connector 23 is illustrated in a latched position where dogs 102 are in engagement with profile 100. Pressurized hydraulic fluid via line 122 forces piston 124 downward forcing dogs 102 into engagement with profile 100. Hydraulic fluid via line 120 forces piston 124 upward releasing dogs 102 and connector 23 from wellhead housing 20. A side outlet 90' in the spool 26 (also see FIGS. 3 and 3A) connects with a line having a valve 30 therein and means to connect with a kill line extending to the drilling vessel. The kill line and its connection to the circulation line will be described below referring to FIGS. 3 and 3A.

The blowout preventer 25 of FIG. 2 is preferably a thirty (30) inch inside diameter annular preventer having the capability to completely shut off the bore. Such a blowout preventer is commercially available, for example, from the Hydril Company and is described at page 48 of the 1982 Hydril Catalog No. 822.

In the line 90 connected in the drilling spool 26 (see FIGS. 2, 3 and 3A), a valve 30, preferably of four and one-sixteenth (4-1/16) inch diameter is provided between the opening and the kill line 32.

Means are provided in conjunction with the apparatus described in FIG. 2 for remotely controlling the blowout preventer 25, the valves 22' and 30 and the wellhead connectors 23 and 45. For example, stab subs between the wellhead connector 23 and the permanent wellhead guide structure 21 are provided to allow hydraulic operation of the vent line valve 22'. Stab subs on top of the blowout preventer stack allow for the connection operation of the hydraulic connector 45 to the mandrel 27. Such stab subs are well known in the art of subsea drilling.

A thirty (30) inch wellhead connector 45 similar to connector 23, is provided with a locking device to fit the profile of the mandrel 27 on top of the blowout preventer 25. A flex joint 33 is connected via riser adapter 31 to the connector 45 and has an upper profile to fit a standard twenty-one (21) inch marine riser 34. Marine riser systems are commercially available, for example, from the VETCO company and are described at page 6847 of the 1978 Composite Catalog.

Guide frame spider 35 slidably connects kill line 32 with guide funnels 36 which guide kill line 32 toward the blowout preventer stack 24. Funnels 36 fit either over the permanent wellhead guide structure or the top of the thirty (30) inch blowout preventer stack 24. A kill line 32 from the drill ship 10 terminates with the female portion of the stab lock hydraulic release connector 39 and mates with the male portion of the blowout preventer stack. The control pod guide frame 40 is provided with arms 41 and 42 for guiding the connector 45 during connection and disengagement of the connector 45 to the thirty (30) inch blowout preventer 25. The control pod guide frame 40 is adapted for operation both with and without the marine riser 34 in place.

Turning now to FIG. 3, the apparatus is illustrated during the drilling operation after the hole for the conductor casing has been drilled within the structural casing 17 and illustrates the apparatus in its state once the marine riser has been removed and the stripper assembly landed. A guide frame 40 guides a thirty (30) inch wellhead connector 50 similar in construction to connectors 45 and 23 with a locking device to fit the profile of the mandrel 27 extending from the top of the thirty (30) inch blowout preventer 25. A thirty (30) inch spool 51 extends upwardly from wellhead connector 50 to a connected stripper assembly 52 approximately twenty (20) feet above the thirty (30) inch wellhead connector 50. Guidance of stripper 52 is aided by guide means 56 during the lowering of the guidance and stripper assembly to the seabed. Releasable retaining means 53 retains spool 51 and connector 50 and stripper assembly 52 to casing 54 as casing 54 is lowered into the sea and until connector 50 is latched to mandrel 27.

Figure 3B:
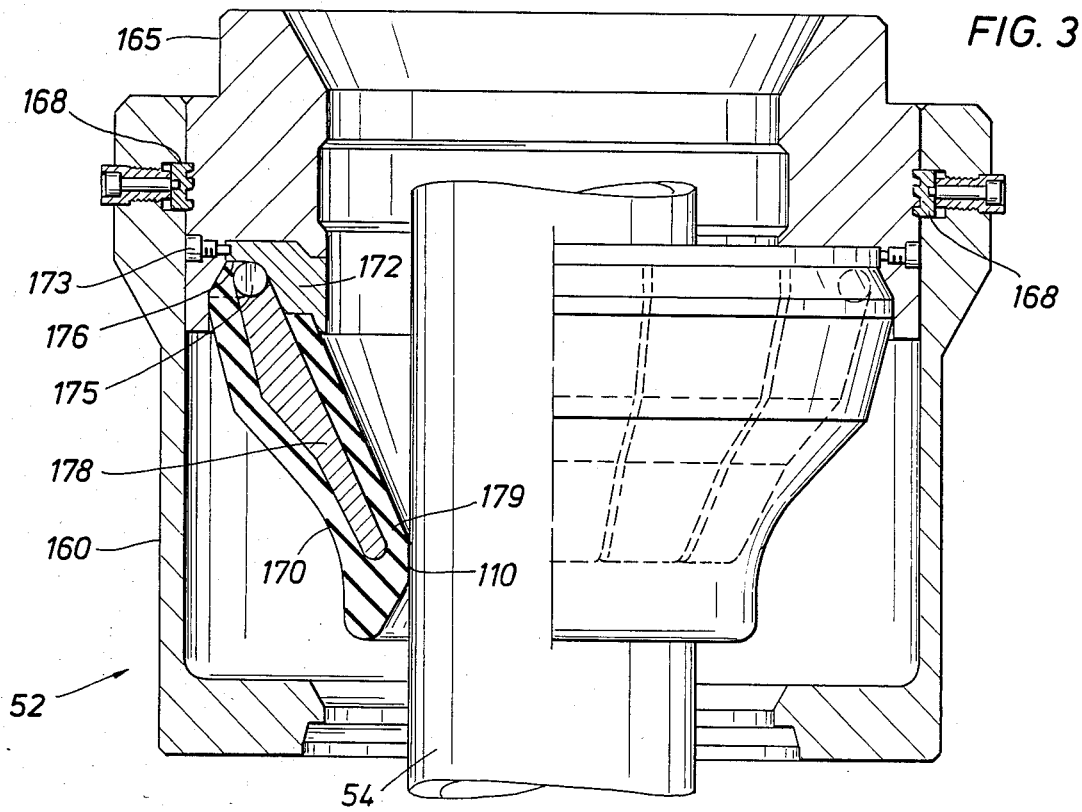
FIG. 3B illustrates the stripping means according to the invention.

FIG. 3B illustrates in more detail the construction of stripper assembly 52. Body 160 is attached to head 165 by means of latching dogs 168. A plurality of stripper rubber members 170 are connected about ring 172 which is attached to head 165 by stud 173. A ring pin 175 connecting stripper rubber members 170 fits within slot 176 in ring 172. Stripper rubber members 170 have an inner metal member 178 about which rubber covering 179 is moulded and adapted to engage the conductor casing along surface 110. Rubber assembly 170 is adapted to hinge about pin 175 as conductor casing or the wellhead housing attached at its top moves downwardly through assembly 52. The wellbore pressure acts to force rubber assembly 170 against casing 54.

Figure 3C:
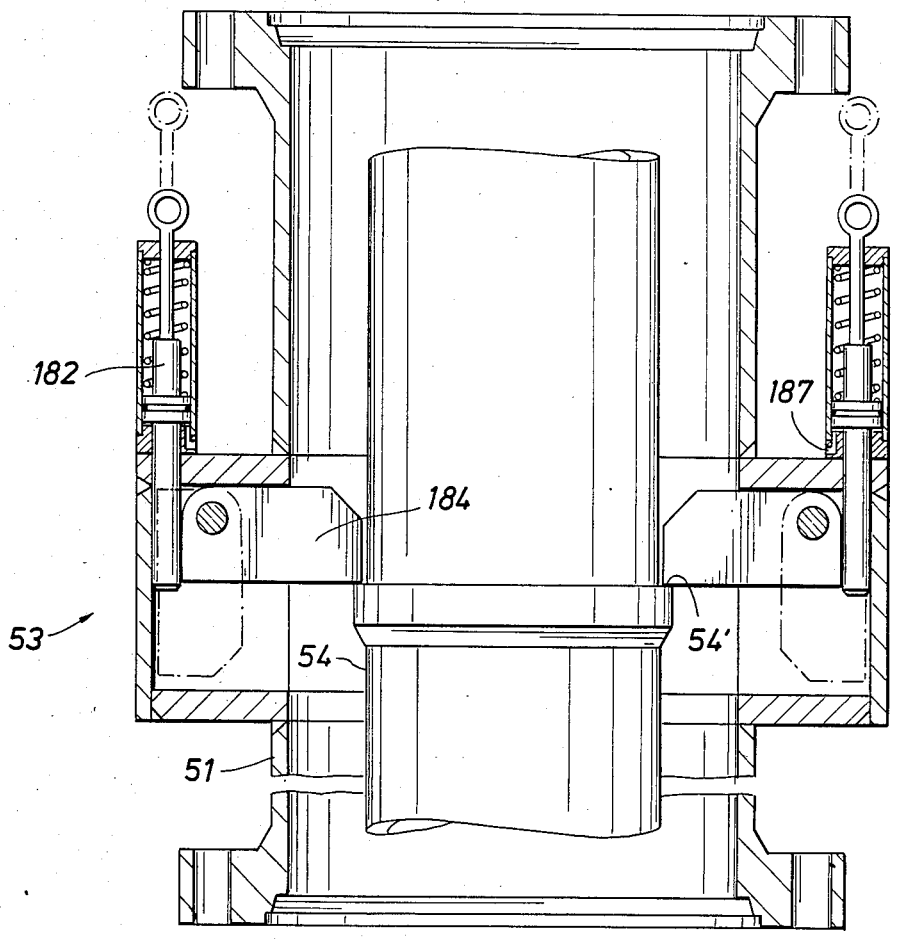
FIG. 3C illustrates the releasable retaining means for retaining the stripper and guiding assembly to the conductor casing while guiding the stripper and conductor casing for landing above the blowout preventer.

FIG. 3C illustrates the releasable retaining means 53 provided to secure spool 51 and stripper conductor casing 54 during lowering of casing 54 into the sea toward the wellhead and until the spool 51 and connector 50 are landed for connection on mandrel 27 atop blowout preventer 25. Advantageously, the first length of conductor casing 54 has connected at its end a cementing shoe 105 which provides a means for inserting cement into the borehole once the conductor casing is in place in the hole.

A plurality of hydraulically driven pins 182 are provided about the periphery of spool 51. A dog 184 is associated with each pin 182 and is held in the engage position when the pin 182 is actuated in a down position and is in a disengage position when the pin is in an up position. The pins and dogs are engaged as the conductor casing 20 is guided downward within spool 51 until the connector 50 attached at the bottom of spool 51 is latched to mandrel 27. Casing 54 supports spool 51 and the apparatus attached to it by means of shoulder 54' in the casing on which dogs 184 rest in the engaged position. Upon landing at the blowout preventer, pins 182 are driven upwardly by hydraulic fluid via unlock ports 187, whereupon dogs 184 disengage from conductor casing 20 allowing the casing to be lowered into the well while being stripped by stripper assembly 52.

Other means for releasably coupling the conductor casing 20 to spool 51 such as shear pins and the like may be used equivalent to the retaining means 53 illustrated herein.

Guide frame spider arms 40 connect the thirty (30) inch wellhead connector 50 to guide funnels 61 and 62 for guidance of the connector 50 and attached spool 51, stripper assembly 52 and retained conductor casing 54 to the top of the posts of the blowout preventer stack. Stab subs are mounted on the guide frame spider to mate with those on the blowout preventer stack for hydraulic operation of the thirty (30) inch wellhead connector 50.

Figure 4:
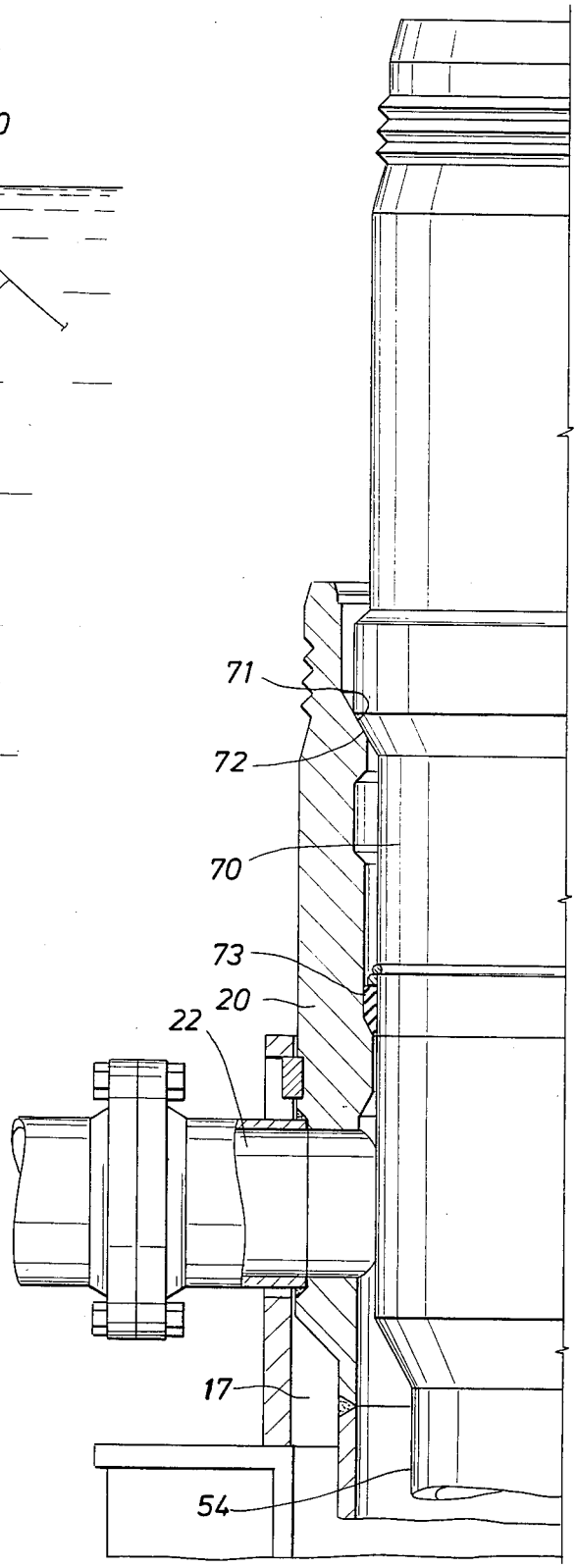
FIG. 4 illustrates the structural casing wellhead connector and the nested conductor casing wellhead connector according to the invention.

FIG. 4 illustrates the wellhead housing 20 after the twenty (20) inch conductor casing 54 has been lowered into the well partially lined by structural casing 17. At the top of twenty (20) inch conductor casing 54 is an eighteen and three quarter (18¾) inch wellhead 70 which is landed within thirty inch wellhead 20 by means of complementary landing shoulders 71 and 72. As discussed above, other size conductor casing and wellhead housings may be used from time to time on particular wells. Advantageously, an elastomeric seal 73 is provided below the landing shoulder 72 to prevent contamination of the upwardly connected blowout preventer during cementing operations. Such a seal may preferably be disposed in the wall of wellhead housing 70, or alternatively may be disposed in the wall of wellhead housing 20. During cementing operations, valve 22' in the vent line 22 is opened and cement returns flow therethrough.

Turning now to the operation of the apparatus and the method of controlling the well while drilling the hole for twenty (20) inch conductor casing and the placing of the casing in the hole, reference will be made first to FIG. 2. Once the thirty (30) inch structural casing 17 is in place and cemented in its hole, blowout preventer stack 24 is lowered to the thirty (30) inch wellhead housing 20. The blowout preventer stack 24 with annular blowout preventer 25 attached is landed on the wellhead housing and wellhead connector 23 is locked into place to wellhead 20. Once the stack 24 is in position and the marine riser 34 is attached to the top of the annular blowout preventer 25 and is tensioned from the rig by tensioning means conventional in the art of floating drilling, a kill line means, preferably a drill pipe, is lowered to the stack beside the marine riser and guided into place by guide frame 35 and is stabbed into a locking connector 39 on the blowout preventer stack 24. The drill pipe 32 provides a conduit between the valve 30 and the line 90 in the spool 26 between the thirty (30) inch wellhead connector 23 and the blowout preventer 25. The drill pipe 32 provides a conduit for providing pressure readings at the drilling vessel with pressure gauge 101. Alternatively, the drill pipe 32 may be used as a kill line between the drilling vessel and the spool 26 on the ocean floor, providing a means to insert mud into the well for well control. The drill pipe 32 may be also opened at the drilling vessel 10 to vent pressurized drilling fluid at the rig when a pressure condition exists in the well.

The next step is to provide a pilot hole for the conductor casing by extending a drilling string through the marine riser 34 and the blowout preventer 25. If a kick is encountered during the drilling of the hole for the conductor casing, a flow diverter 200, provided at the top of the marine riser and typically disposed in the cellar 15 of the vessel 10, is used to divert drilling fluid overboard. After the pressure has been relieved, mud conditioning that is necessary to stabilize the hole is performed and drilling continues until the appropriate depth is reached. Once the required depth has been reached and the hole has been under-reamed properly, the marine riser is removed to the surface after closing the annular blowout preventer 25 on the open hole achieving complete shut off.

After the marine riser has been removed and the annular blowout preventer has achieved complete shut off, valve 22' in vent line 22 connected to the thirty (30) inch wellhead 20 may be used to vent the well subsea if a pressure condition is sensed by means of pressure gauge 101 connected via kill line 32. Another use for valve 22' in line 22 is to open the line under the condition of lost circulation of the well in order to let ocean water flow into the hole.

Even though the annular blowout preventer 25 is closed, the kill line 32, typically comprising links of five (5) inch drill pipe, with pressure gauge 101 attached thereto, enables the operator to know the condition of the pressure in the well. The operator may make a decision as to whether or not to vent the well through the kill line or if there is more pressure in the well than may adequately be handled by the five (5) inch drill pipe, the ten (10) inch valve 22' at the wellhead 20 may be opened to vent line 22 to the ocean.

As stated previously, the five (5) inch drill pipe kill line may also be used to kill the well by pumping mud back into it even though the marine riser may have been removed. If necessary, cement may be pumped via the kill line to control well. Thus, an advantageous feature of the apparatus and method disclosed herein is that at all times the operator has means to determine the pressure condition in the well and has means with which to control the well once the marine riser has been removed.

As illustrated in FIG. 3 a guidance and stripper support assembly is guided into engagement with the top of the thirty (30) inch blowout preventer 25. A thirty (30) inch wellhead connector 50 is provided to latch to the top of the mandrel 27 extending from the thirty (30) inch blowout preventer. Approximately twenty (20') feet above the wellhead connector 50 is a stripper assembly 52 that is aided by wellbore pressure to provide a friction fit between the stripper assembly 52 and the conductor casing to be lowered into the well. Any pressure in the drilling spool 51 between the wellhead connector 50 and the stripper assembly 52 acts to energize the stripper assembly to make the seal tighter. Guide means 56 comprising arms and funnels guide stripper 52 along guide wires 18 as the assembly is lowered into the sea. It should be emphasized however that the stripper assembly is not a blowout preventer, but merely acts to strip the conductor casing into the well.

The conductor casing 54 releasably supports the stripper assembly 52 and spool 51 by means of releasable retaining means 53. The conductor casing is lowered along with the guidance and stripper assembly until the wellhead connector 50 at the bottom of spool 51 is latched to mandrel 27 atop blowout preventer 25. A cementing shoe 105 is advantageously connected to the end of the length of the structural casing 54 extending through the stripper 52 and partially within spool 51. Once the guidance and stripper assembly is attached to the top of the blowout preventer 25, the conductor casing 54 is released by actuation of retaining means 53 and is lowered further into the spool 51 to prevent loss of guidance during the up and down motion of the casing 54 with respect to the stripper assembly 52 during drilling vessel 10 heave.

The kill line 32 with the surface pressure gauge 101 provides a means for the operator to know the condition of the well and to make a decision as to whether or not to vent the well or take control measures or to begin lowering the conductor casing into the well. If the well is under control, the operator opens the blowout preventer and lowers the casing through the bore of the blowout preventer. The annular blowout preventer 25 does not provide a general means to strip the conductor casing by means of the friction of the packing unit, but if several hundred feet of casing had been lowered into the well and the stripper rubber of the stripper assembly 52 were to fail, low pressure may be applied to the annular packing element of the annular blowout preventer to continue stripping the conductor casing into the well.

Attached to the top of the conductor casing is an eighteen and three quarter (18¾) inch wellhead assembly 70 (see FIG. 4) typically with either a 10,000 or a 15,000 psi working pressure rating. Such a wellhead assembly is adapted to pass through the thirty (30) inch diameter of the spool 51 and through the bore of blowout preventer 25. Thus, the wellhead housing is lowered through the annular blowout preventer and nests within the thirty (30) inch wellhead 20 by means of complementary landing shoulders 71,72. Advantageously, a seal 73 is provided beneath the complementary landing shoulders 71,72 to prevent cement returns from contaminating the blowout preventer 25.

After the twenty (20) inch casing 54 is landed within housing 20, standard cementing procedures are begun. The returns are exited through the ten (10) inch valve 22' in line 22 connected to the wellhead housing 20. Valve 22' remains open throughout the cementing process.

Once the conductor casing 54 and attached wellhead assembly 70 is cemented into place, the cementing and casing running tools are removed to the surface, and the five (5) inch drill pipe kill line 32 is released and pulled to the surface. Then, a running tool attached to drill pipe is run down the guideline into the stripping assembly and locked into place. The lower blowout preventer stack connector is then released and the entire stack comprising the blowout preventer and the stripper and guidance assembly is returned to the drilling vessel.

Thus, an apparatus and method of operation are provided to maintain well control during well operations of lowering and cementing conductor casing in the hole. Advantageously, a blowout preventer system is provided to control the well during the time that the marine riser is removed and before a novel guidance and stripping assembly is attached. According to the invention, a unique kill line provides the operator at the surface with a means to determine the pressure conditions in the hole during drilling and conductor casing operations.

From the foregoing it is apparent that there has been provided an apparatus and method for use in drilling a hole for conductor casing and casing it for subsea well operations. Various modifications and alterations in the described apparatus and method will be apparent to those skilled in the art from the foregoing description which does not depart from the spirit of the invention. For this reason, these changes are desired to be included in the scope of the appended claims. The appended claims recite the only limitations of the present invention and the descriptive matter which is employed for setting forth the present embodiment and is to be interpreted as illustrative and not limitative.

What is claimed is:

1. Well apparatus adapted for use with a floating drilling vessel and adapted for connection to the structural casing string in a well bore established beneath the seabed comprising, a conductor casing, a first wellhead connected to the structural casing string, a first conductor means for connecting a first conduit to the first wellhead, an annular blowout preventer connected to the first conduit providing a flow path between the bore of the wellhead and the bore of the annular blowout preventer when the blowout preventer is normally open, a valve disposed in a line connected to the first conduit between the blowout preventer and the first wellhead connector, a kill line extending between the line and the drilling vessel, and stripper and guidance means connected to the blowout preventer by a second connector for guiding said conductor casing through the blowout preventer and into the borehole and for stripping said conductor casing while it is being inserted therein.

2. The apparatus of claim 1 further comprising a vent line connected to the first wellhead at one end, the other end being open to the sea, and having a vent valve in the line.

3. The apparatus of claim 2 wherein said vent line has a ten inch inside diameter.

4. The apparatus of claim 1 wherein the first conduit is a drilling spool connected between the first connector means and the annular blowout preventer.

5. The apparatus of claim 4 wherein said wellhead, first connector means, drilling spool, annular blowout preventer and second connector means each having a thirty inch bore.

6. The apparatus of claim 5 wherein the casing string has a twenty inch outside diameter.

7. The apparatus of claim 1 wherein said valve is a four and one-sixteenth (4 1/16) inch valve and said kill line is a plurality of five inch drill pipe lengths joined end-to-end.

8. The apparatus of claim 1 further comprising, a permanent guide base resting on a temporary guide base under which the well bore is established, the permanent guide base having vertically extending guide posts, a stack frame having vertically extending female members for mating with the guide posts and vertically extending male posts, and an adapter frame having vertically extending female members for mating with the frame male posts, wherein guide lines are disposed from the temporary guide base to the floating drilling rig and extend through the guide posts of the permanent guide base, the posts extending vertically from the stack frame, and the female members of the adapter frame.

9. The apparatus of claim 1 wherein said first wellhead further comprises a landing shoulder adapted to support a second wellhead attached to the top of the conductor casing.

10. The apparatus of claim 9 further comprising an elastomeric seal disposed in the wall of said second wellhead below the landing shoulder.

11. Casing stripper and guiding apparatus adapted for use with an annular blowout preventer in communication with a borehole, the apparatus comprising, a conductor casing being run into the borehole via the annular blowout preventer, a connector means adapted for connecting the annular blowout preventer to a spool means having an inside diameter substantially the same as that of the blowout preventer and extending upwardly from the wellhead connector means, and stripper means attached to the spool for stripping said conductor casing therethrough.

12. The casing stripper and guiding apparatus of claim 11 further comprising, releasable retaining means for securing the conductor casing to the spool during guiding and attachment of the casing stripper and guiding apparatus to the blowout preventer and for releasing the conductor casing from the connecting means.

13. The casing stripper and guiding apparatus of claim 11 further comprising guide arm means extending from the stripper means and having guide funnel means for guiding the stripper means and retained casing to the top of the blowout preventer via guide wires extending from the drilling rig to the blowout preventer.

14. Well apparatus adapted for use with a floating drilling vessel and adapted for connection to the structural casing string in a well bore established beneath the seabed comprising, a conductor casing, a first wellhead connected to the structural casing string, a first connector means for connecting a first conduit to the first wellhead, an annular blowout preventer connected to the first conduit providing a flow path between the bore of the wellhead and the bore of the annular blowout preventer when the blowout preventer is normally open, and stripper and guidance means connected to the blowout preventer by a second connector for guiding said conductor casing through the blowout preventer and into the borehole and for stripping said conductor casing while it is being inserted therein.

15. The apparatus of claim 14 further comprising a valve disposed in a line connected to the first conduit between the blowout preventer and the first wellhead connector, a kill line extending between the line and the drilling vessel and having a pressure gauge in the kill line disposed at the drilling vessel.

16. In a well established beneath the sea floor by means of a floating drilling vessel and having apparatus adapted for connection to the structural casing string in the well established beneath the seabed and having, a wellhead connected to the structural casing string, a first wellhead connector means for connecting additional apparatus to the first wellhead housing, an annular blowout preventer connected to the first wellhead connector means by a first conduit providing a flow path between the bore of the wellhead and the bore of the annular blowout preventer when the blowout preventer is in its normal open position, a valve disposed in a line connected to the first conduit between the blowout preventer and the first wellhead connector, a kill line extending between the line and the drilling vessel, a vent line connected to the first wellhead at one end, the other end being open to the sea, and having a vent valve in the line, a marine riser connected by means of a second wellhead connector means to the top of the annular blowout preventer, and a flow diverter attached to the riser above the sea surface below the rotary table of the drilling rig, a method to control the well while establishing conductor casing in the well comprising the steps of, drilling a bore hole for establishing the conductor casing and diverting any gas kicks encountered while drilling by means of the flow diverter attached to the top of the marine riser, removing the drill string from the well and closing the annular blowout preventer for complete vertical flow path shut off, disconnecting the second wellhead connector means from the blowout preventer and removing the marine riser diverter and connector, connecting a stripper and guidance assembly having a stripping means and having a length of the conductor casing releasably retained therein to the top of the blowout preventer, opening the blowout preventer, and stripping the conductor casing into the well by means of the stripping means.

17. The method of claim 16 further comprising, after the step of closing the annular blowout preventer for complete shut off, monitoring the well pressure by means of a pressure gauge disposed at the drilling vessel and connected in the kill line, and venting the well on the occurrence of pressure in the well by means of the kill line or the vent line.

18. The method of claim 16 wherein the connecting step comprises, securing a cementing shoe to the end of the conductor casing, attaching the conductor casing to a releasable retaining means connected to the stripping means for releasably retaining the conductor casing to the stripper and guidance assembly, landing the stripper and guidance assembly on the annular blowout preventer, actuating the releasable retaining means to allow the conductor casing to move up and down with respect to the stripper and guidance assembly to compensate for vessel heave, and connecting the stripper and guidance assembly to the annular blowout preventer.

19. The method of claim 16 further comprising the step of using the annular blowout preventer to strip the conductor casing into the well if the stripping means becomes damaged.

20. The method of claim 16 further comprising the steps of securing a second wellhead to the top of the length of conductor casing, and landing the second wellhead in the first wellhead secured to the structural casing string.

21. The method of claim 20 further comprising the step of cementing the conductor casing into the well.

22. The method of claim 21 wherein the cementing step includes the step of opening the vent valve disposed in the vent line connected to the first wellhead housing to provide a circulation return for the cement.

23. The method of claim 21 further comprising the steps of, disconnecting and removing the kill line from the blowout preventer stack, and disconnecting and removing the stripper and guidance assembly and the blowout preventer from connection with the first wellhead.

24. In a well established beneath the sea floor by means of a floating drilling vessel and having an annular blowout preventer connected to the flow path of a structural casing string in the well and a marine riser connected between the annular blowout preventer and the drilling vessel, a method to control the well while establishing conductor casing in the well comprising the steps of, drilling a borehole for establishing the conductor casing in the hole, closing the annular blowout preventer for complete shut off of the well, disconnecting and removing the marine riser, attaching a stripper and guidance means to the top of the annular blowout preventer, opening the annular blowout preventer, and stripping the conductor casing into the well.

25. The method of claim 24 further comprising the step of landing a wellhead to the top of the conductor casing within a wellhead attached to the structural casing in the well.

26. The method of claim 25 further comprising the step of cementing the conductor casing in the well.

27. In a well established beneath the sea floor by means of a floating drilling vessel and having an annular blowout preventer connected to the flow path of a structural casing string in the well, a method to control the well while establishing conductor casing in the well comprising the steps of, drilling a borehole for establishing the conductor in the hole, closing the annular blowout preventer for complete shut off of the well, attaching a stripper and guidance means to the top of the annular blowout preventer, opening the annular blowout preventer, and stripping the conductor casing into the well.

28. The method of claim 27 further comprising the step of landing a wellhead attached to the top of the conductor casing within a wellhead attached to the structural casing in the well.

29. In a well established beneath the sea floor by means of a floating drilling vessel and having an annular blowout preventer connected to the flow path of a structural casing string in the well, a method to control the well while establishing conductor casing in the well comprising the steps of, drilling a borehole for establishing the conductor casing in the hole, closing the annular blowout preventer for complete shut off of the well, attaching a stripper and guidance means to the top of the annular blowout preventer, opening the annular blowout preventer, and stripping the conductor casing into the well.

30. The method of claim 29 further comprising the step of landing a wellhead attached to the top of the conductor casing within a wellhead attached to the structural casing in the well.

* * * * *